United States Patent [19]

Ootsuka

[11] Patent Number: 4,940,958

[45] Date of Patent: Jul. 10, 1990

[54] POLARIZED ELECTROMAGNETIC APPARATUS

[75] Inventor: Shigeharu Ootsuka, Aichi, Japan

[73] Assignee: Mitsubishi Denki Kabushiki Kaisha, Tokyo, Japan

[21] Appl. No.: 413,002

[22] Filed: Sep. 26, 1989

[30] Foreign Application Priority Data

Sep. 29, 1988 [JP] Japan ..... 63-245000

[51] Int. Cl.[5] ..... H01F 7/08

[52] U.S. Cl. ..... 335/230; 335/236

[58] Field of Search ..... 335/230, 229, 234, 236, 335/78, 79, 85

[56] References Cited

U.S. PATENT DOCUMENTS 4,730,175 3/1988 Ichikawa et al. ..... 335/230

FOREIGN PATENT DOCUMENTS 57-180832 11/1982 Japan .

63-79304 4/1988 Japan .

63-133604 6/1988 Japan .

*Primary Examiner*—H. Broome

*Attorney, Agent, or Firm*—Burns, Doane, Swecker & Mathis

[57] ABSTRACT

The polarized electromagnetic apparatus consists of a stationary core assembly and a movable core assembly. The movable core assembly is made up of a movable core spindle and one movable core plate attached to one end surface thereof. Since the movable core assembly has only one movable core plate as opposed to two movable core plates in the conventional apparatus, the complete movable core assembly can be installed into the electromagnetic coil, facilitating the assembly work. A pole piece is mounted to the inner surface of the stationary cores on the side of the other end surface of the movable core spindle. The second end surface of the movable core spindle is inserted into the pole piece, so that an additional attractive force can be obtained. This construction makes the overall attractive force greater than can be obtained with the conventional apparatus.

3 Claims, 3 Drawing Sheets

POLARIZED ELECTROMAGNETIC APPARATUS

BACKGROUND OF THE INVENTION

1. Field of the Invention

This invention relates to a polarized electromagnetic apparatus in which a movable core assembly is driven by the combined attracting force of a permanent magnet and a electromagnetic coil, and more specifically to the construction of the movable core assembly.

2. Description of the Prior Art

FIGS. 4A and 4B show the construction of a conventional polarized electromagnetic apparatus disclosed, for example, in the Japanese Patent Unexamined Publication No. 79304/1988. FIG. 4A represents the movable core assembly in a reset state and FIG. 4B in an attracted state. The arrow indicates the flow of magnetic flux. In the figures, reference numeral 1 denotes a U-shaped stationary core and 2 and L-shaped pole plate. Designated 4 is a movable core spindle which has a first movable core plate 5 and a second movable core plate 5a, both secured to the end surfaces thereof to form a movable core assembly.

Designated 6 is an electromagnetic coil and 7 a permanent magnet. One of the pole faces of the permanent magnet 7 is placed in contact with the central portion of the U-shaped stationary core 1 and the other pole face is placed in contact with the central portion of the L-shaped pole plate 2.

P represents a first magnetic gap formed between the leg of the U-shaped stationary core 1 and the first movable core plate 5. Q indicates a second magnetic gap formed between the first movable core plate 5 and the leg of the L-shaped pole plate 2. R1 is a third magnetic gap formed between the second movable core plate 5a and the other leg of the U-shaped stationary core 1.

The above is the construction of the conventional polarized electromagnetic apparatus. When the electromagnetic coil 6 is not energized, the greatest attractive force generated by the flux of the permanent magnet 7 indicated by broken line arrows in FIG. 4A acts upon the first magnetic gap P. The movable core assembly therefore is forced in the Y direction and attracted to the leg of the U-shaped stationary core 1, so that it is maintained in the reset condition.

When under this condition the electromagnetic coil 6 is energized, magnetic flux indicated by solid line arrows in FIG. 4A is generated. In the first magnetic gap P, the flux (broken line arrows) of the permanent magnet 7 and the flux (solid line arrows) of the electromagnetic coil 6 cancel each other, reducing the attractive force. In the second and third magnetic gaps Q, R1, the combined attractive force is produced by the permanent magnet 7 and the electromagnetic coil 6. The combined attractive force acting on the second and third gaps Q, R1 is greater than the attractive force in the first gap P, driving the movable core assembly toward the X direction until it comes in contact with the other leg of the U-shaped stationary core 1. The movable core assembly is now kept in its attracted state by the flux indicated by the solid line arrows and the broken line arrows in FIG. 4B.

Let us take a contactor for example. Though not shown, the contactor has a trip spring and a spring for generating the contact pressure, all these spring loads acting in the Y direction as a reactionary force. Under the attracted state, when the electromagnetic coil 6 is deenergized, the movable core assembly is driven in the Y direction to return to the reset state because the reactionary force is set larger than the attractive force of the flux generated by the permanent magnet 7.

In such a conventional polarized electromagnetic apparatus where the movable core assembly has the first movable core plate 5 and the second movable core plate 5a secured to each end surface of the movable core spindle 4, the complete movable core assembly cannot be installed into the electromagnetic coil 6. Thus, it is necessary to first pass the movable core spindle 4 through the electromagnetic coil 6 and then fix the first movable core plate 5 or the second movable core plate 5a to the movable core spindle 4. This makes the assembly work difficult.

SUMMARY OF THE INVENTION

This invention has been accomplished to solve the above problem.

It is therefore an object of the invention to provide a polarized electromagnetic apparatus which can be assembled with ease without deteriorating the attractive force characteristic.

To achieve the above objective, the polarized electromagnetic apparatus according to this invention has one of the pole faces of the permanent magnet placed in contact with the central portion of the almost U-shaped stationary core and the other pole face placed in contact with the central portion of the L-shaped pole plate. The apparatus also has a ring-shaped pole piece attached to the first leg of the stationary core to form the stationary core assembly.

The movable core spindle that passes through the hole of the electromagnetic coil installed inside the L-shaped pole plate is secured at one end surface with a movable core plate installed between the second leg of the stationary core and the leg of the L-shaped pole plate, with the other end surface of the movable core spindle inserted into the pole piece, to form the movable core assembly.

A first magnetic gap, a second magnetic gap and a third magnetic gap are formed, from the reset position side to the attracted position side, between the second leg of the stationary core and the movable core plate, between the movable core plate and the leg of the L-shaped pole plate, and between the end surface of the movable core spindle and the first leg of the stationary core, respectively.

In this invention, the permanent magnet inserted between the central portion of the stationary core and the central portion of the L-shaped pole plate produces magnetic flux that acts upon the first magnetic gap, attracting the movable core plate to the second leg of the stationary core to keep it in the reset state.

In this condition, when the electromagnetic coil is applied with a voltage, magnetic flux is generated by the coil and, in the first magnetic gap, the flux of the permanent magnet and the flux produced by the coil are canceled out, reducing the attractive force. In the second and third gaps, on the other hand, the combined attractive force generated by the permanent magnet and the coil becomes larger than the attractive force in the first gap, so that the movable core plate is attracted to the leg of the L-shaped pole plate and the end surface of the movable core spindle is attracted to the first leg of the stationary core. They remain there in the attracted state.

DESCRIPTION OF THE PREFERRED EMBODIMENT

Now, one embodiment of this invention will be described by referring to the attached drawings.

Figure 1:
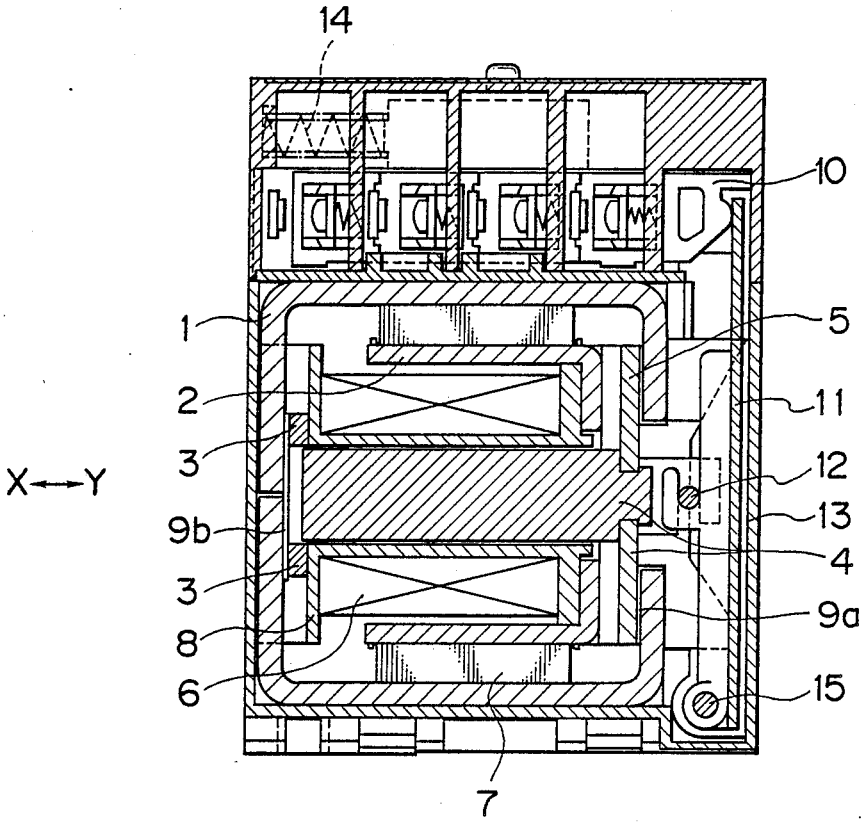
FIG. 1 is a cross section showing a magnetic contactor as one embodiment of the invention.

FIG. 1 is a cross section showing a magnetic contactor as one embodiment of this invention. In the figure, reference numeral 1 represents a U-shaped stationary core; 2 an L-shaped pole plate; 3 a pole piece; 4 a movable core spindle; 5 a first movable core plate; 6 an electromagnetic coil; 7 a permanent magnet; 8 a coil spool; 11 a link; 15 a fulcrum shaft for the link 11; 12 a connecting shaft connecting the movable core spindle 4 and the link 11; **9*a* and 9*b* spacers for adjusting the stroke and the attractive force; and 10 a cross bar driven by the link 11 to move the movable contact mounted on the movable contact carrier in the magnetic contactor. Denoted 13 is a case containing the electromagnet and contact; and 14** is a trip spring to return the movable core assembly from the attracted position to the reset position.

Next, the operation will be explained. FIG. 1 shows the apparatus in the reset state. When in this condition the coil is energized, the movable core spindle 4 is attracted in the X direction as indicated by the arrow and the cross bar 10 is moved by the link 11 in the X direction. At this time the movable contact engages with the stationary contact of the magnetic contactor, conducting electricity. On the contrary, when the coil is deenergized, the trip spring 14 returns the movable core spindle 4 to the reset position.

Figure 2A:
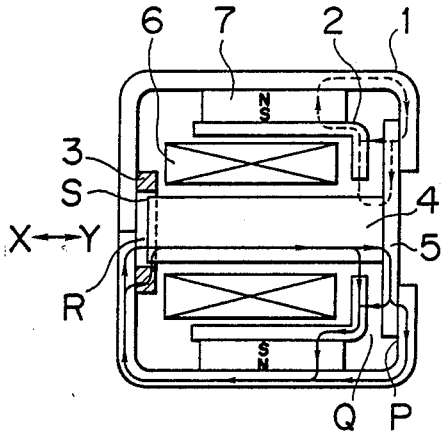
FIGS. 2A and 2B are cross sections showing the construction of the above embodiment.
Figure 2B:
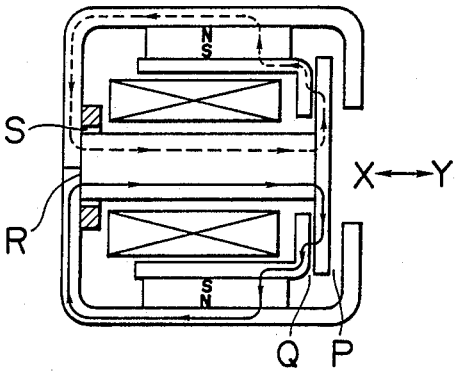

FIGS. 2A and 2B are cross sections showing the construction of the polarized electromagnetic apparatus as one embodiment of the invention, with FIG. 2A illustrating the movable core assembly in the reset state and FIG. 2B illustrating it in the attracted state. The arrows represent the flow of magnetic flux.

In the figure, designated 1 is a U-shaped stationary core whose first leg extends nearly to the central part thereof. Denoted 2 is an L-shaped pole plate, and 3 represents a ring-shaped pole piece which is centered at the joint of the first legs of the oppositely arranged U-shaped stationary cores 1.

Denoted 4 is a movable core spindle which has a first movable core plate 5 secured to one end surface thereof and has the other end surface inserted into the pole piece 3 to form the movable core assembly. The first movable core plate 5 is disposed between the second leg of the U-shaped stationary core 1 and the leg of the L-shaped pole plate 2.

6 is an electromagnetic coil. 7 is a permanent magnet installed between the U-shaped stationary core 1 and the L-shaped pole plate 2, with its pole faces placed in contact with the central portion of the U-shaped stationary core 1 and with the central portion of the L-shaped pole plate 2.

Designated P is a first magnetic gap formed between the second leg of the U-shaped stationary core and the first movable core plate 5. Denoted Q is a second magnetic gap formed between the first movable core plate 5 and the leg of the L-shaped pole plate 2. Denoted R is a third magnetic gap formed between the end surface of the movable core spindle 4 and the first leg of the U-shaped stationary core 1. Denoted S is a fourth magnetic gap formed between the pole piece 3 and the outer circumference of the movable core spindle 4 inserted into the pole piece 3.

In the polarized electromagnetic apparatus with the above construction, when the electromagnetic coil 6 is not energized, the flux of the permanent magnet 7 as shown by the broken line arrows in FIG. 2A produces the largest attractive force in the first magnetic gap P. Thus, the movable core assembly is moved in the Y direction and attracted to the second leg of the U-shaped stationary core 1, so that it is kept in the reset state.

When the electromagnetic coil 6 is energized, the magnetic flux indicated by solid line arrows in FIG. 2A is generated. In the first magnetic gap P, the flux of the permanent magnet 7 (broken line arrows) and the flux of the electromagnetic coil 6 (solid line arrows) cancel each other out, reducing the attractive force that exists in the first gap P. In the second gap Q, third gap R and fourth gap S on the other hand, the combined attractive force produced by the permanent magnet 7 and the coil 6 becomes player than the attractive force in the first gap P, driving the movable core assembly in the X direction until it comes into contact with the first leg of the U-shaped stationary core 1. The movable core assembly then remains attracted to the second leg of the stationary core 1 by the fluxes indicated by the solid and broken line arrows in FIG. 2B.

The attractive force in the third magnetic gap R for this embodiment is smaller than that for the conventional apparatus because the area of the end surface of the movable core spindle 4 facing the gap is smaller. However, the flux linking the fourth magnetic gap S adds to the force that draws the end of the movable core spindle 4 inserted in the magnetic ring 3 further into the ring. In total, the force tending to drive the movable core assembly in the X direction is greater than that in the conventional apparatus.

If we consider the contactor for example, the trip spring and the contact pressure spring together generate a reactionary force in the Y direction. When, with the movable core assembly in the attracted state, the coil 6 is deenergized, the reactionary force which is set higher than the attractive force generated by the flux of the permanent magnet 7 causes the movable core assembly to return in the Y direction to the reset position.

Figure 3A:
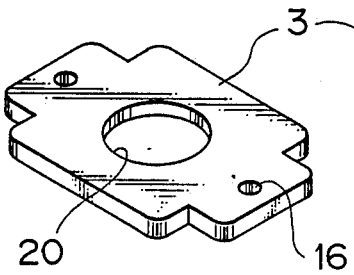
FIGS. 3A and 3B each is a perspective view showing a pole piece.
Figure 3B:
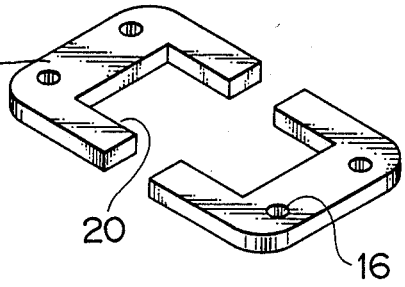
Figure 4A:
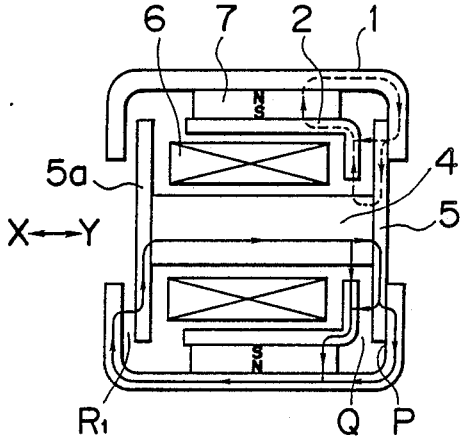
FIG. 4A PRIOR ART
FIGS. 4A and 4B are cross sections showing the construction of the conventional polarized magnetic apparatus.
Figure 4B:
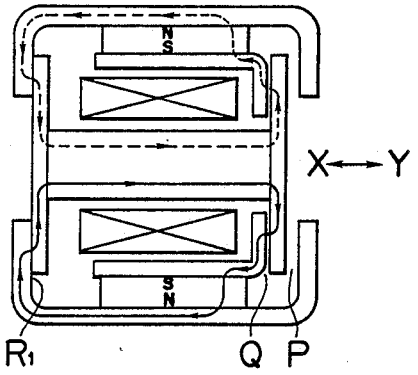
FIG. 4B PRIOR ART

FIG. 3 shows the construction of the pole piece 3, which is formed of magnetic material with a hole at the center into which the movable core spindle 4 is inserted. The diameter of the hole in the pole piece is slightly larger than that of the movable core spindle 4 so as to form a fourth gap S therebetween. Since it is desired that the fourth gap S be as small as possible, it is set smaller than the third gap R, e.g. $\frac{1}{3}$–$\frac{2}{3}$ of R. The pole piece may either be formed as a circular ring as shown in FIG. 3A or it may be divided as shown in FIG. 3B. When the end portion of the movable core spindle 4 inserted in the magnetic ring 3 is formed into a square shape to increase the flux, the pole piece shape need be changed accordingly.

The pole piece 3 is secured to the first legs of the stationary core 1 by means of the threaded screw.

To summarize, the polarized electromagnetic apparatus according to the invention has the following advantages. Since the movable core plate is secured only to one end surface of the movable core spindle to form the movable core assembly, it is possible to install the complete movable core assembly into the electromagnetic coil. This facilitates the assembly work. Further, since the other end surface of the movable core spindle is inserted in the pole piece mounted on the stationary core, the attractive force is greater than can be obtained with the conventional apparatus.

Also, since the second end surface of the movable core spindle has no movable core plate attached thereto, the winding space available for the coil is larger than in the conventional apparatus. This in turn allows the ampereturn (magnetomotive force) of the coil to be increased, contributing to an increase in the attractive force.

What is claimed is:

1. A polarized electromagnetic apparatus having a movable core assembly, said core assembly being driven by a combined attractive force of a permanent magnet and an electromagnetic coil against a reset spring force when the electromagnetic coil is energized and said movable core assembly being driven by the reset spring force when the electromagnetic coil is de-energized, comprising:

at least one stationary core (1) having a substantially U-shaped cross section, said U-shaped cross section having a first leg and a second leg opposing each other and an inner surface;

a permanent magnet (7) having a first pole and a second pole, said first pole being in contact with said inner surface of said stationary core (1);

a pole plate (2) in contact with said second pole and forming a first clearance (P,Q) between said second leg;

an electromagnetic coil (6) disposed between said first and second legs;

a bar-shaped movable core (4) disposed between said first and second legs and movably extending through said electromagnetic coil (6), said bar-shaped movable core (4) having a first end and a second end, said bar-shaped movable core (4) having a movable core plate (5) which is secured at said first end of said bar-shaped movable core and extends into said first clearance (P,Q), said bar-shaped movable core (4) displaces in a longitudinal direction thereof to a first position where said movable core plane (5) is attracted by and contacts with said second leg when said electromagnetic coil (6) is de-energized and to a second position where said second end of said bar-shaped movable core (4) is attracted by and contacts with said first leg when said electromagnetic coil (6) is energized;

a pole piece (3) secured to said first leg and having a hole (20) therein through which said bar-shaped movable core (4) displaces to said second position.

2. A polarized electromagnetic apparatus according to claim 1, wherein said bar-shaped movable core (4) forms a second clearance (S) between said hole (20) in said pole piece (3) when said second end of said bar-shaped movable core (4) is attracted by and contacts with said first leg, and said bar-shaped movable core (4) forming a third clearance (R) between said first leg, said second clearance (S) being smaller than said third clearance.

3. A polarized electromagnetic apparatus having a movable magnetic core assembly, a magnetic stationary core, and an electromagnetic coil for magnetizing the movable magnetic core assembly, comprising:

at least one magnetic stationary core (1) having a substantially U-shaped cross section, said U-shaped cross section having a first leg and a second leg opposing each other;

an electromagnetic coil (6) disposed between said first and second legs;

a bar-shaped movable core (4) disposed between said first and second legs and movably extending through said electromagnetic coil (6), said movable bar-shaped magnetic core (4) having a cross sectional area;

a movable core plate (5) secured to one end of said bar-shaped movable core and is attracted by and contacts with said first leg through a contact area greater than said cross sectional area of said bar-shaped movable core (4) when said electromagnetic coil (6) is de-energized;

a pole piece (3) secured to said first leg and having a hole (20) therein through which said bar-shaped movable core (4) displaces as attracted by and contacts with said first leg when said electromagnetic coil (6) is energized.

* * * * *